US012258961B2

(12) United States Patent
Schnittger et al.

(10) Patent No.: US 12,258,961 B2
(45) Date of Patent: Mar. 25, 2025

(54) FAULT RECTIFICATION METHOD FOR A PROGRESSIVE CAVITY PUMP OF A CONVEYOR DEVICE FOR CONVEYING VISCOUS BUILDING MATERIALS

(71) Applicant: J. WAGNER GmbH, Markdorf (DE)

(72) Inventors: Thorsten Schnittger, Frickingen (DE); Lam Huu Nguyen, Woodbury, MN (US); Florian Spindler, Ravensburg (DE); Alfred Göhring, Salem (DE)

(73) Assignee: J. WAGNER GmbH, Markdorf (DE)

( * ) Notice: Subject to any disclaimer, the term of this patent is extended or adjusted under 35 U.S.C. 154(b) by 0 days.

(21) Appl. No.: 18/043,833

(22) PCT Filed: Aug. 27, 2021

(86) PCT No.: PCT/EP2021/073718
§ 371 (c)(1),
(2) Date: Mar. 2, 2023

(87) PCT Pub. No.: WO2022/048997
PCT Pub. Date: Mar. 10, 2022

(65) Prior Publication Data

US 2023/0349378 A1 Nov. 2, 2023

(30) Foreign Application Priority Data

Sep. 4, 2020 (DE) ..... 10 2020 123 119.9

(51) Int. Cl.
*F04C 14/28* (2006.01)
*F04C 2/107* (2006.01)
*F04C 14/06* (2006.01)

(52) U.S. Cl.
CPC ..... *F04C 14/28* (2013.01); *F04C 2/1071* (2013.01); *F04C 14/06* (2013.01);
(Continued)

(58) Field of Classification Search
CPC ..... F04C 28/28; F04B 49/06; F04B 49/065; F04B 49/10; F04B 2203/0204
See application file for complete search history.

(56) References Cited

U.S. PATENT DOCUMENTS 3,417,968 A * 12/1968 Schlecht ..... B01F 35/754551 366/186
11,786,401 B2 * 10/2023 Samakar ..... A61F 9/00781 604/9

FOREIGN PATENT DOCUMENTS

DE 29812231 U1 10/1998
EP 2781749 A1 9/2014
WO WO2019215242 A1 11/2019

OTHER PUBLICATIONS

International Search Report and Written Opinion for International Patent Application No. PCT/EP2021/073718, mailing date of: Nov. 23, 2021, 14 pages with English Translation.

* cited by examiner

*Primary Examiner* — Anthony Ayala Delgado
(74) *Attorney, Agent, or Firm* — Christopher J. Volkmann; Kelly, Holt & Christenson PLLC

(57) ABSTRACT

A fault-rectification method for an eccentric screw pump of a conveying apparatus for conveying viscous construction materials, comprising the steps of monitoring a start of a conveying operation of the eccentric screw pump by way of a characteristic-variable-monitoring program of a control device of the conveying apparatus, wherein a working-free program is executed by the control device of the eccentric screw pump if, for one or more characteristic variables. The characteristic-variable-monitoring program acquires characteristic-variable values which are stored, alone or in combination with one another, as fault values that indicate jamming of a rotor/stator unit of the eccentric screw pump,
(Continued)

and wherein otherwise a conveying operation is begun. The eccentric screw pump is operated in the working-free program in such a way that an electric motor of a drive unit of the conveying apparatus is multiply alternately switched on and switched off.

14 Claims, 3 Drawing Sheets

(52) U.S. Cl.
CPC ..... *F04C 2240/40* (2013.01); *F04C 2240/81* (2013.01); *F04C 2270/052* (2013.01); *F04C 2270/07* (2013.01); *F04C 2270/18* (2013.01); *F04C 2270/195* (2013.01); *F04C 2270/86* (2013.01)

FAULT RECTIFICATION METHOD FOR A PROGRESSIVE CAVITY PUMP OF A CONVEYOR DEVICE FOR CONVEYING VISCOUS BUILDING MATERIALS

CROSS-REFERENCES TO RELATED APPLICATIONS

This Application is a Section 371 National Stage Application of International Application No. PCT/EP2021/073718, filed Aug. 27, 2021, and published as WO 2022/048997A1 on Mar. 10, 2022, and claims priority to German Application No. 10 2020 123 119.9, filed Sep. 4, 2020, the contents of each are hereby incorporated by reference in their entirety.

DETAILED DESCRIPTION

Figure 1:
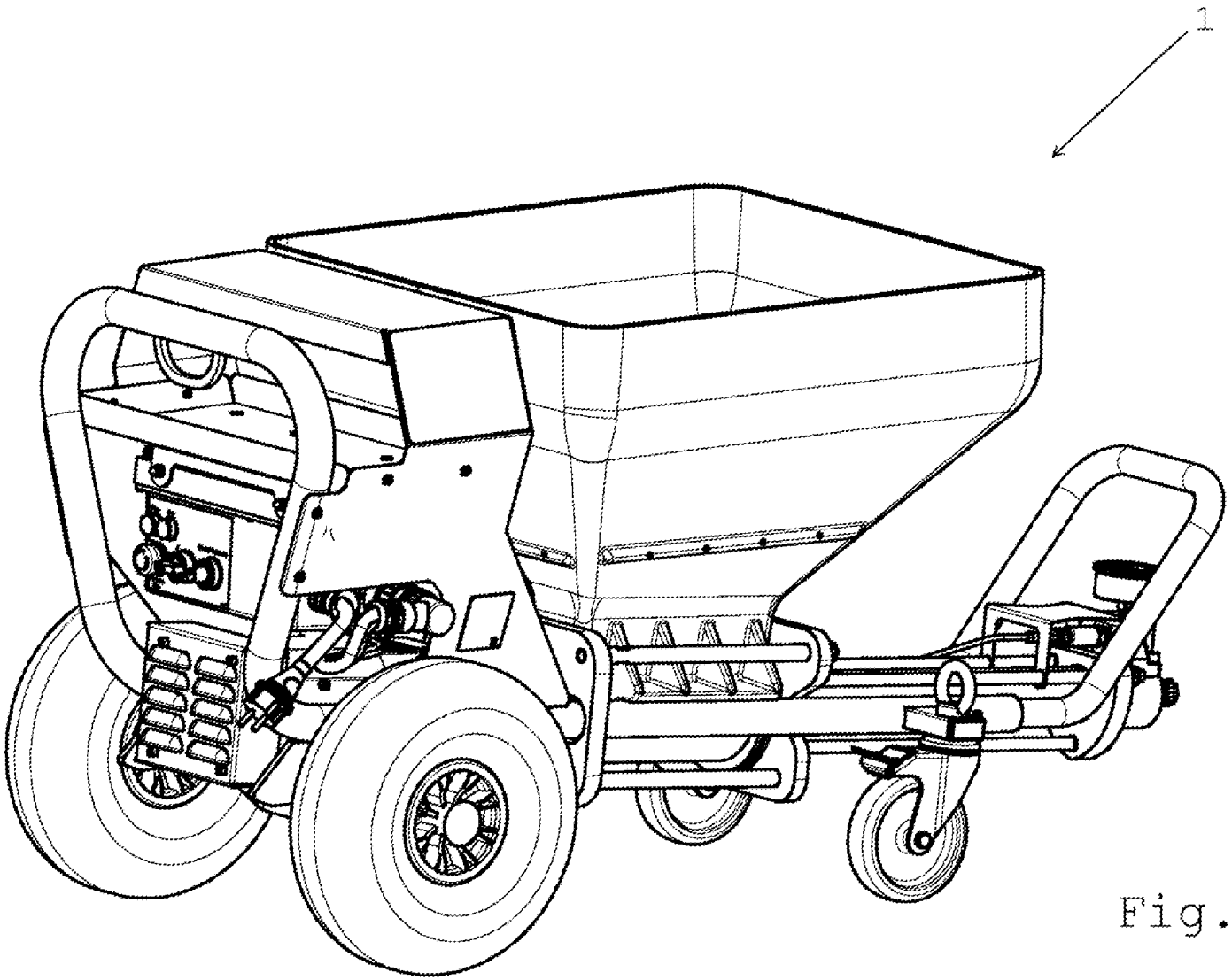
FIG. 1 shows a perspective view of a conveying apparatus, in one example.

The present disclosure relates to a fault-rectification method for an eccentric screw pump of a conveying apparatus for conveying viscous construction materials as per the preamble of claim 1.

WO 2019/215242 A1 has disclosed a method for operating a conveying apparatus for conveying a free-flowing construction material in which the target pressure is regulated on the basis of the detection of at least one characteristic variable. A conveying apparatus operated in this way is not capable of detecting, and/or rectifying, jamming of a rotor/stator unit of the eccentric screw pump during startup.

The present disclosure is based on an object of proposing a fault-rectification method for an eccentric screw pump of a conveying apparatus for conveying viscous construction materials by means of which operation of the eccentric screw pump is simplified.

Said object is achieved by the method sequence specified in claim 1. Advantageous and expedient refinements are specified in the dependent claims.

The fault-rectification method according to one example for an eccentric screw pump of a conveying apparatus for conveying viscous construction materials comprises the steps of:

- monitoring a start of a conveying operation of the eccentric screw pump by way of a characteristic-variable-monitoring program of a control device of the conveying apparatus;
- wherein a working-free program is executed by the control device of the eccentric screw pump if, for one or more characteristic variables, the characteristic-variable-monitoring program acquires characteristic-variable values which are stored, in particular in a memory, alone or in combination with one another, as fault values that indicate jamming of a rotor/stator unit of the eccentric screw pump, and wherein otherwise, if no jamming has been detected, the conveying operation is begun;
- wherein the eccentric screw pump is operated in the working-free program in such a way that an electric motor of a drive unit of the conveying apparatus is multiply automatically alternately switched on and switched off. The use of a method of said type simplifies the operation of the conveying apparatus for a user, since the control device of the eccentric screw pump can automatically identify, and generally automatically rectify, jamming.

Furthermore, it is provided that, after the end of the working-free program, the characteristic-variable-monitoring program is restarted, wherein, from the characteristic-variable-monitoring program, either the working-free program is restarted, if, for one or more characteristic variables, the characteristic-variable-monitoring program acquires characteristic-variable values which are stored, alone or in combination with one another, as fault values that indicate jamming of a rotor/stator unit of the eccentric screw pump, or otherwise the conveying operation is begun. In this way, it is ensured that the eccentric screw pump is not operated for an unnecessarily long time in the working-free program and the waiting time is thus kept as short as possible and additional loading of the eccentric screw pump is thus kept as short as possible too. In this way, it is furthermore also ensured that, by way of multiple starting of the working-free program, even relatively stubborn jamming of the eccentric screw pump can be released with acceptable loading of the eccentric screw pump.

It is also provided that, each time the drive unit is switched on in the working-free program, it is switched in each case only into forward running or in each case only into reverse running or regularly or irregularly alternatively into forward running and into reverse running. Practical tests have shown that jamming of the eccentric screw pump can generally be released by way of all four variants or else arbitrary combinations of these four variants.

Furthermore, it is provided that, prior to a restart of the working-free program, a pause time is allowed to elapse and/or a limit temperature is allowed to be reached by cooling, and that the working-free program is run through only a fixed number of times and then a complete shutdown of the conveying apparatus is carried out. In this way, the working-free program can be executed multiple times without there being a risk of overloading the eccentric screw pump, since, via the pause time and/or allowing of a limit temperature to be reached by cooling, it is ensured that the eccentric screw pump and the drive thereof, which comprises in particular a gear mechanism and a BLDC electric motor, are loaded by way of the working-free program only within permissible limits. Furthermore, a complete shutdown avoids unnecessary loading of the eccentric screw pump if the jamming cannot be rectified by a normal procedure.

It is provided that a rotational speed and/or a current consumption and/or a pressure and/or a temperature are/is detected as a characteristic variable. Monitoring of characteristic variables of said type, and in particular monitoring of multiple characteristic variables of said type, makes it possible to easily ascertain whether the eccentric screw pump is jammed or is operating in conveying operation. Characteristic variables of said type are available at modern eccentric screw pumps, or can be made available with little technical effort.

Finally, provision is made for a rotational speed and/or a current consumption and/or a pressure downstream of the rotor/stator unit and/or a temperature to be saved in a memory of the control device as a fault value. In this way, fault values saved in the control device are available for comparison with presently detected characteristic-variable values.

Jamming of an eccentric screw pump of a conveying apparatus is to be understood within the context of the present disclosure as meaning that the rotor of a rotor/stator unit through which viscous construction material is conveyed is jammed in the stator. Said jamming occurs in particular if, there, construction material has solidified and/or is clumped together and/or has become extremely viscous. "Jamming" can occur in particular if, after a pause in use of the conveying apparatus, the torque that normally prevails at the rotor of the rotor/stator unit during startup is not sufficient for turning the rotor in the stator due to lack of lubrication or due to lack of separating agent or on account of dried-on mortar residues or dried-on paint residues. In other words, "jamming" is to be understood as meaning sticking and/or adhering and/or caking-on and/or drying-on of the rotor, which is manufactured in particular from metal, in the stator, which is produced in particular from rubber.

The "jamming" is evident in particular in that the rotational speed of the rotor or the rotational speed of the electric motor is equal to zero despite very high current consumption of the electric motor. A further indicator is that the pressure in the system and in particular in the rotor/stator unit and in the hose is equal to zero upstream of the delivery apparatus, which is in the form of a gun. This is also the characteristic difference from a blockage occurring downstream of the eccentric screw pump in the hose or the gun, in the case of which the pressure is very high upstream of the blockage.

Further details of examples of the invention will be described in the drawing on the basis of schematically illustrated exemplary embodiments.

In FIG. 1, a conveying apparatus 1 for carrying out the method according to one example is shown in a perspective view.

Figure 2:
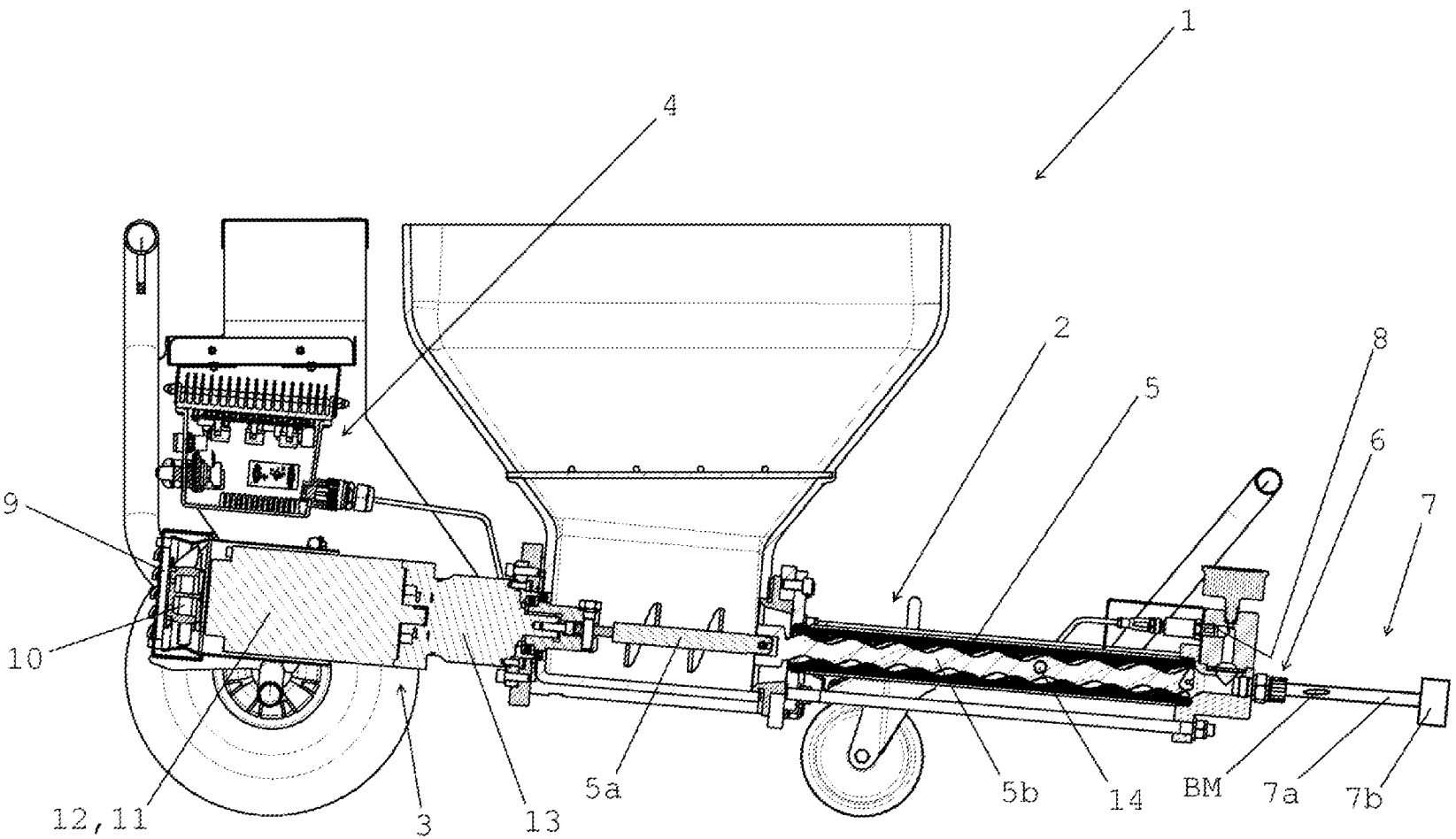
FIG. 2 shows a sectional side view of the conveying apparatus shown in FIG. 1.

In FIG. 2, the conveying apparatus 1 known from FIG. 1 is illustrated in a partially sectional side view. The conveying apparatus 1 comprises an eccentric screw pump 2, a drive unit 3 and a control device 4. The eccentric screw pump 2 comprises a rotor/stator unit 5 with an upstream conveying screw 5*a* and with an outlet 6. The conveying apparatus 1 furthermore comprises a schematically illustrated conveying section 7, which is connected to the outlet 6 of the rotor/stator unit 5. The conveying section 7 comprises a hose 7*a* and a delivery apparatus 7*b*, by means of which the discharge of viscous construction material BM is able to be activated and able to be deactivated and preferably is also able to be dosed.

The conveying apparatus 1 furthermore comprises a first pressure sensor 8 and a characteristic-variable-detecting device 9. In this case, a pressure at which the construction material BM is at the outlet 6 of the rotor/stator unit 5 is detected by the pressure sensor 8. The characteristic-variable-detecting device 9 comprises a rotational-speed sensor 10, by means of which a rotational speed of an electric motor 11 of the drive unit 3 of the conveying device 1 is able to be detected. In this case, the electric motor 11 is in the form of a brushless direct-current motor, a so-called BLDC electric motor 12, and the rotational-speed sensor 10 comprises at least one HALL sensor which is installed directly on the BLDC electric motor 12. Beside the drive 11, the drive unit 3 also comprises a gear mechanism 13, which is installed between the drive 11 and the eccentric screw pump 2.

A schematically illustrated temperature sensor 14 is installed on the conveying device. In this case, a temperature of a rotor 5*b* of the rotor/stator unit 5 is detected by the temperature sensor 14.

Figure 3:
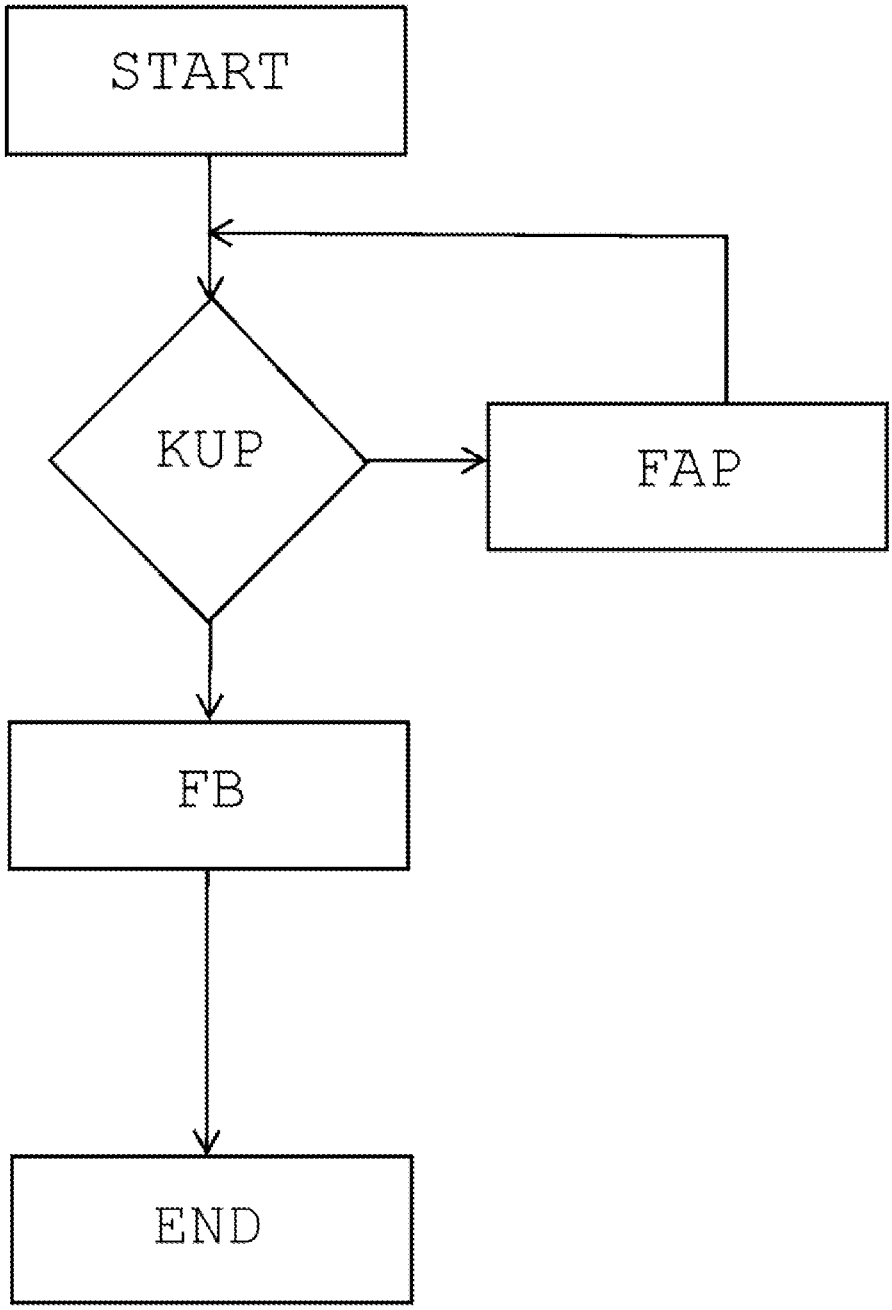
FIG. 3 shows a schematic flow diagram of a fault-rectification method, in one example.

In FIG. 3, a flow diagram of a fault-rectification method SBV is schematically shown.

The fault-rectification method SBV comprises the steps of:

monitoring a start of a conveying operation of the eccentric screw pump 5 of the conveying apparatus 1 by way of a characteristic-variable-monitoring program KUP of the control device 4 of the conveying apparatus 1.

executing a working-free program FAP by way of the control device 4 of the conveying apparatus 1 if, for one or more characteristic variables, the characteristic-variable-monitoring program KUP acquires characteristic-variable values which are stored, alone or in combination with one another, as fault values that indicate jamming of a rotor/stator unit 5 of the eccentric screw pump 2, and otherwise beginning a conveying operation PB;

operating the eccentric screw pump 5 in the working-free program FAP in such a way that an electric motor 11 of a drive unit 3 of the conveying apparatus 1 is multiply alternately switched on and switched off.

As a further step of the fault-rectification method SBV, provision may be made for:

restarting the characteristic-variable-monitoring program KUP, wherein, from the characteristic-variable-monitoring program KUP, either the working-free program FAP is restarted, if, for one or more characteristic variables, the characteristic-variable-monitoring program KUP acquires characteristic-variable values which are stored, alone or in combination with one another, as fault values that indicate jamming of a rotor/stator unit 5 of the eccentric screw pump 2, or otherwise the conveying operation is begun.

The fault values are stored or saved in a memory of the control device.

For the working-free program FAP, it is provided that the drive unit 3, upon being switched on, is switched only into forward running or only into reverse running or regularly or irregularly alternatively into forward running and into reverse running.

In the entire programme sequence of the fault-rectification method SBV, it may be provided that, prior to each restart of the working-free program FAP, a pause time is allowed to elapse and/or a limit temperature is allowed to be reached by cooling, and that the working-free program FAP is run through only a fixed number of times and then a complete shutdown of the conveying apparatus is carried out. In this case, provision is made for monitoring of a temperature of the rotor 5*b* by means of the temperature sensor 14 to a limit temperature saved in the control device 4.

In the fault-rectification method SBV, use is made of a rotational speed and/or a current consumption and/or a pressure downstream of the rotor/stator unit 5 and/or a temperature as a characteristic variable for a fault value. In this case, rotational speed and current consumption are detected directly at the BLDC motor 12. In this case, pressure and temperature are detected by means of the pressure sensor 8 and the temperature sensor 14.

Although the present invention has been described with reference to preferred embodiments, workers skilled in the art will recognize that changes may be made in form and detail without departing from the spirit and scope of the invention.

LIST OF REFERENCE SIGNS

1 Conveying apparatus
2 Eccentric screw pump
3 Drive unit

4 Control device
5 Rotor/stator unit
5*a* Conveying screw of 5
5*b* Rotor of 5
6 Outlet
7 Conveying section
7*a* Hose of 7
7*b* Delivery apparatus of 7
8 Pressure sensor
9 Characteristic-variable-detecting device
10 Rotational-speed sensor
11 Electric motor
12 BLDC electric motor
13 Gear mechanism
14 Temperature sensor
BM Viscous construction material
FAP Working-free program
PB Conveying operation
KUP Characteristic-variable-monitoring program
SBV Fault-rectification method

The invention claimed is:

1. A conveying apparatus for conveying viscous construction materials, the conveying apparatus comprising:
an eccentric screw pump comprising a rotor/stator unit;
a drive unit comprising an electric motor; and
a control device that is programmatically configured to:
monitor a start of a conveying operation of the eccentric screw pump by way of a characteristic-variable-monitoring program of the control device that acquires characteristic-variable values for one or more characteristic variables; and
execute a working-free program if the characteristic-variable values are stored, alone or in combination with one another, as fault values that indicate jamming of the rotor/stator unit of the eccentric screw pump, and wherein the control device is configured to otherwise begin the conveying operation;
operate the eccentric screw pump in the working-free program in such a way that the electric motor is multiply alternately switched on and switched off, wherein, prior to each restart of the working-free program, the control device is configured to allow a pause time to elapse and/or allow a limit temperature to be reached by cooling, and the working-free program is run through only a fixed number of times and then the control device carries out a complete shutdown of the conveying apparatus.

2. The conveying apparatus of claim 1, wherein the control device is configured to:
restart, after an end of the working-free program, the characteristic-variable-monitoring program, wherein, from the characteristic-variable-monitoring program, either the working-free program is restarted, if, for the one or more characteristic variables, the characteristic-variable-monitoring program acquires characteristic-variable values which are stored, alone or in combination with one another, as one or more fault values that indicate jamming of the rotor/stator unit.

3. A conveying apparatus for conveying viscous construction materials, the conveying apparatus comprising:
an eccentric screw pump comprising a rotor/stator unit;
a drive unit comprising an electric motor; and
a control device that is programmatically configured to:
monitor a start of a conveying operation of the eccentric screw pump by way of a characteristic-variable-monitoring program of the control device that acquires characteristic-variable values for one or more characteristic variables;
execute a working-free program if the characteristic-variable values are stored, alone or in combination with one another, as fault values that indicate jamming of the rotor/stator unit of the eccentric screw pump, and wherein the control device is configured to otherwise begin the conveying operation;
operate the eccentric screw pump in the working-free program in such a way that the electric motor is multiply alternately switched on and switched off, wherein, each time the drive unit is switched on in the working-free program, the drive unit is switched regularly or irregularly alternatively into forward running and into reverse running.

4. The conveying apparatus of claim 1, wherein the control device is configured to detect, as the one or more characteristic variables, at least one of:
a rotational speed,
a current consumption,
a pressure downstream of the rotor/stator unit, or
a temperature.

5. The conveying apparatus of claim 1, wherein the control device is configured to save in memory, as a fault value of the fault values, at least one of:
a rotational speed,
a current consumption,
a pressure downstream of the rotor/stator unit, or
a temperature.

6. A conveying apparatus for conveying viscous construction materials, the conveying apparatus comprising:
an eccentric screw pump comprising a rotor/stator unit;
a drive unit comprising an electric motor; and
a control device that is programmatically configured to:
monitor a start of a conveying operation of the eccentric screw pump by way of a characteristic-variable-monitoring program of the control device that acquires characteristic-variable values for one or more characteristic variables;
execute a working-free program if the characteristic-variable values are stored, alone or in combination with one another, as fault values that indicate jamming of the rotor/stator unit of the eccentric screw pump, and wherein the control device is configured to otherwise begin the conveying operation;
operate the eccentric screw pump in the working-free program in such a way that the electric motor is multiply alternately switched on and switched off;
stop the working-free program;
prior to restarting the working-free program, determine occurrence of a restart criterion comprises at least one of:
a pause time period; or
limit temperature due to cooling of the conveying apparatus; and
in response to the occurrence of the restart criterion, restart the working-free program.

7. The conveying apparatus of claim 6, wherein the control device is configured to:
count a number of times the working-free program is run; and
in response to the number of times the working-free program is run reaching a threshold number, shut down the conveying apparatus.

8. A conveying apparatus that conveys viscous construction materials, the conveying apparatus comprising:
an eccentric screw pump comprising a rotor/stator unit;

a drive unit comprising an electric motor; and a control device that is programmatically configured to:

monitor a start of a conveying operation of the eccentric screw pump using a characteristic-variable-monitoring program that acquires characteristic-variable values for one or more characteristic variables;

execute a working-free program if the characteristic-variable values are stored, alone or in combination with one another, as fault values that indicate jamming of the rotor/stator unit of the eccentric screw pump;

stop the working-free program;

prior to restarting the working-free program, determine occurrence of a restart criterion comprises at least one of:

a pause time period; or limit temperature due to cooling of the conveying apparatus;

in response to the occurrence of the restart criterion, restart the working-free program;

count a number of times the working-free program is run; and in response to the number of times the working-free program is run reaching a threshold number, shut down the conveying apparatus.

9. The conveying apparatus of claim 3, wherein the control device is configured to detect, as the one or more characteristic variables, at least one of:

a rotational speed, a current consumption, a pressure downstream of the rotor/stator unit, or a temperature.

10. The conveying apparatus of claim 3, wherein the control device is configured to save in memory, as the fault values, at least one of:

a rotational speed, a current consumption, a pressure downstream of the rotor/stator unit, or a temperature.

11. The conveying apparatus of claim 6, wherein the control device is configured to detect, as the one or more characteristic variables, at least one of:

a rotational speed, a current consumption, a pressure downstream of the rotor/stator unit, or a temperature.

12. The conveying apparatus of claim 6, wherein the control device is configured to save in memory, as the fault values, at least one of:

a rotational speed, a current consumption, a pressure downstream of the rotor/stator unit, or a temperature.

13. The conveying apparatus of claim 8, wherein the control device is configured to detect, as the one or more characteristic variables, at least one of:

a rotational speed, a current consumption, a pressure downstream of the rotor/stator unit, or a temperature.

14. The conveying apparatus of claim 8, wherein the control device is configured to save in memory, as the fault values, at least one of:

a rotational speed, a current consumption, a pressure downstream of the rotor/stator unit, or a temperature.

* * * * *